US005195935A

United States Patent [19]

Fencel

[11] Patent Number: 5,195,935

[45] Date of Patent: Mar. 23, 1993

[54] EXERCISE APPARATUS WITH AUTOMATIC VARIATION OF PROVIDED PASSIVE AND ACTIVE EXERCISE WITHOUT INTERRUPTION OF THE EXERCISE

[75] Inventor: Stanley R. Fencel, Newport Beach, Calif.

[73] Assignee: SF Engineering, Fountain Valley, Calif.

[21] Appl. No.: 633,225

[22] Filed: Dec. 20, 1990

[51] Int. Cl.[5] ..... A63B 22/00

[52] U.S. Cl. ..... 482/70; 482/908; 482/66; 482/52

[58] Field of Search ..... 272/69, 70, 71, 72, 272/73, 93, 97, 129, 131, 132; 128/25 R, 25 B; 482/51, 52, 54, 70, 71, 908, 2

[56] References Cited

U.S. PATENT DOCUMENTS

| | | | |
|---|---|---|---|
| 1,982,843 | 12/1934 | Traver | 272/70 |
| 2,093,830 | 9/1937 | Flatley | 272/70 |
| 2,427,761 | 9/1947 | Bull | 272/57 |
| 2,696,206 | 12/1954 | Bierman | 128/25 |
| 2,892,455 | 6/1959 | Hutton | 128/25 |
| 2,923,289 | 2/1960 | Carson | 128/25 R |
| 2,924,214 | 2/1960 | Zak | 128/25 R |
| 2,969,060 | 1/1961 | Swanda et al. | 128/25 |
| 3,301,553 | 1/1967 | Brakeman | 272/80 |
| 3,460,272 | 8/1969 | Pellicore | 35/29 |
| 3,582,069 | 6/1971 | Flick et al. | 272/79 |
| 3,643,943 | 2/1972 | Erwin et al. | 272/69 |
| 3,824,994 | 7/1974 | Soderberg, Sr. | 128/25 |
| 4,342,452 | 8/1982 | Summa | 272/69 |
| 4,733,858 | 3/1988 | Lah | 272/97 |
| 4,743,015 | 5/1988 | Marshall | 272/97 |

FOREIGN PATENT DOCUMENTS

| | | | |
|---|---|---|---|
| 89/07473 | 8/1989 | World Int. Prop. O. | 272/69 |

*Primary Examiner*—Stephen R. Crow
*Attorney, Agent, or Firm*—Richard L. Gausewitz

[57] ABSTRACT

The apparatus comprises reciprocating footpads to which are coupled a D.C. electric motor. A D.C. power supply and control means are assocated with the motor to vary the voltage delivered to it. A load sensor and isolator sense the voltage supplied by the power supply, and also sense the voltage present at the motor terminals during periods when no power is being supplied to the motor by the power supply. The sensor and isolator also isolate the motor from the power supply during certain periods, namely when the power supplied to the motor by the exerciser is greater than that supplied by the power supply. An electrical load circuit and load set vary the motor load.

39 Claims, 5 Drawing Sheets

EXERCISE APPARATUS WITH AUTOMATIC VARIATION OF PROVIDED PASSIVE AND ACTIVE EXERCISE WITHOUT INTERRUPTION OF THE EXERCISE

BACKGROUND OF THE INVENTION

A large number of exercising machines have been conceived and patented, and may be classified generally into passive and active types. In the passive types of exercising apparatus, an electric motor moves the legs and/or arms (limbs) of the exerciser. In the active types, motive power is supplied by the exerciser, who works against various loads.

Despite the large number of types of apparatus which have been devised and used over many decades, there remains a major need for a method and apparatus which provide active and passive exercising, which can be transitioned from any desired degree of active exercising to any desired degree of passive exercising without stopping the machine, which can be used with maximum safety at various degrees of incline ranging from the horizontal to quite steep, which has stride-length adjustments that can be effected while the apparatus is in motion, and which is characterized by harmonic motion and by the absence of jerks or jolts even if the motor is suddenly turned off. It is highly desirable that the machine be self-contained so as to be readily movable to any location. The mechanism for achieving any degree of inclination must be simple yet rugged and effective.

SUMMARY OF THE INVENTION

The present apparatus and method achieve all of the needs stated in the preceding paragraph. Under the full control of the exerciser, at all times, the present machine can be used in its passive mode, at any desired speed, to warm up the exerciser. Then, the passive mode can be shifted, in any time frame, to active mode with any desired load, and with the exerciser at all times controlling speed and load. The apparatus either moves the exerciser or is moved by him or her. It warms up the exerciser and then—after the exercise is over—can automatically cool the exerciser down.

The apparatus and method are extremely versatile, in that they provide simulated climbing, walking, running, skiing, and other actions.

Two oscillating foot pads have a master-slave relationship. The exerciser controls the amplitude of their oscillations, namely stride length, at all times, whether the machine is stopped or in motion. The foot pads are adjusted simultaneously so that each, at all times, has the same amplitude of oscillation but in 180-degree out-of-phase relationship relative to the other. The motion of each foot pad is harmonic, sinusoidal, there being no jerking or abrupt action at any time even when the supply of electric power to the motor is abruptly terminated.

The platform of the machine is adjustable in inclination to an infinite number of angles, within the desired range, from horizontal to steep. Incline adjustment may be made while the machine is in motion. For example, the foot pads may be caused to oscillate in a horizontal plane to simulate cross-country skiing, or in an inclined plane to simulate climbing. For the steeper angles of inclination, the foot pads are adjusted so as to insure against slipping.

At all times, there are strong rails at the sides and in front of the exerciser. When the angle is adjusted from horizontal to steep, the rail in front of the exerciser automatically moves forwardly so that the exerciser may remain vertical without contacting such front rail. Conversely, when the machine is adjusted from inclined to horizontal operation, the front rail automatically moves rearwardly so as to remain relatively close to the exerciser without at any time interfering with his or her motions.

The apparatus and method employ controlled electrical dynamic braking; there is no need for any mechanical brake--nc need to stop the mechanism in order to adjust the resistance presented by the apparatus to the exerciser. The apparatus and method employ, in combination with the master-slave foot pads, a variable-radius actuating crank or pitman, the variable radius being controllable electrically at any time.

One aspect of the invention involves a compound linkage system by which the actuating means for changing the inclination of the plane of oscillation remains substantially vertical at all times. Such actuating means forms one leg of a triangular linkage, the platform for the oscillating foot pads forming another link of such triangular linkage. The triangular linkage is combined with a parallelogram linkage including the rails, and the linkages work conjointly to provide the desired positions for both (1) the rail means held by the exerciser, and (2) the actuating means for raising and lowering the plane of oscillation to different desired inclinations.

Another aspect involves a simple and economical inclination-adjustment mechanism that is self contained. It has a mast that remains vertical, the mast including a lead screw that is in tension, without side load, so as to remain straight and true. A significant reduction in lifting torque is effected.

The present apparatus and method benefit the entire spectrum of persons engaging in physical activities. People in excellent health can maintain and improve their condition. On the other hand, stroke, heart, and cerebral palsy patients—and other motor-deficient individuals—can exercise or be exercised.

DETAILED DESCRIPTION OF THE PREFERRED EMBODIMENT

Figure 1:
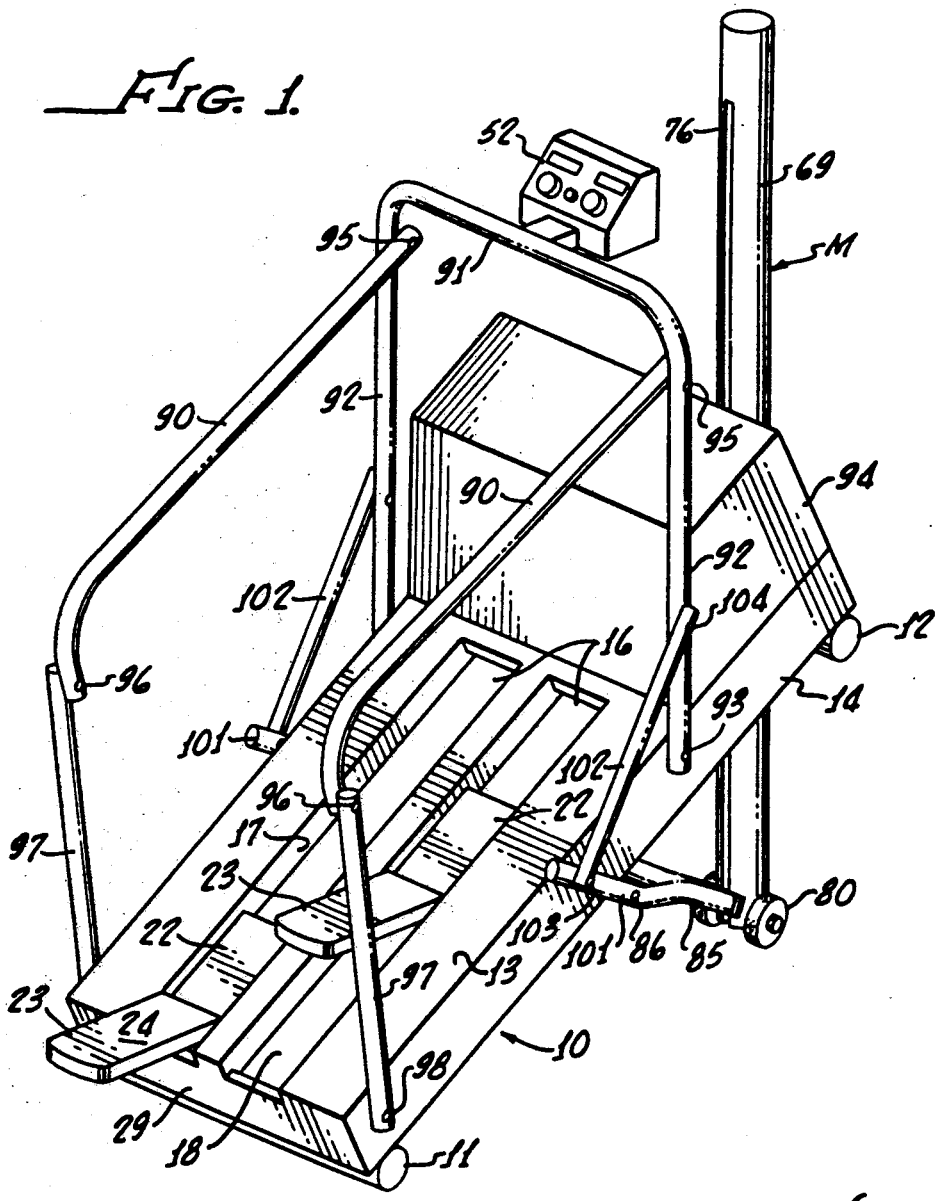
FIG. 1 is an isometric view showing the apparatus adjusted for simulating climbing, walking uphill, etc.
Figure 7:
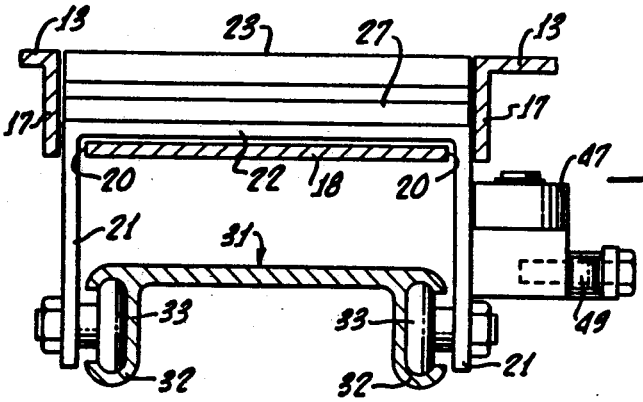
FIG. 7 is a fragmentary vertical sectional view on line 7—7 of FIG. 6.
Figure 12:
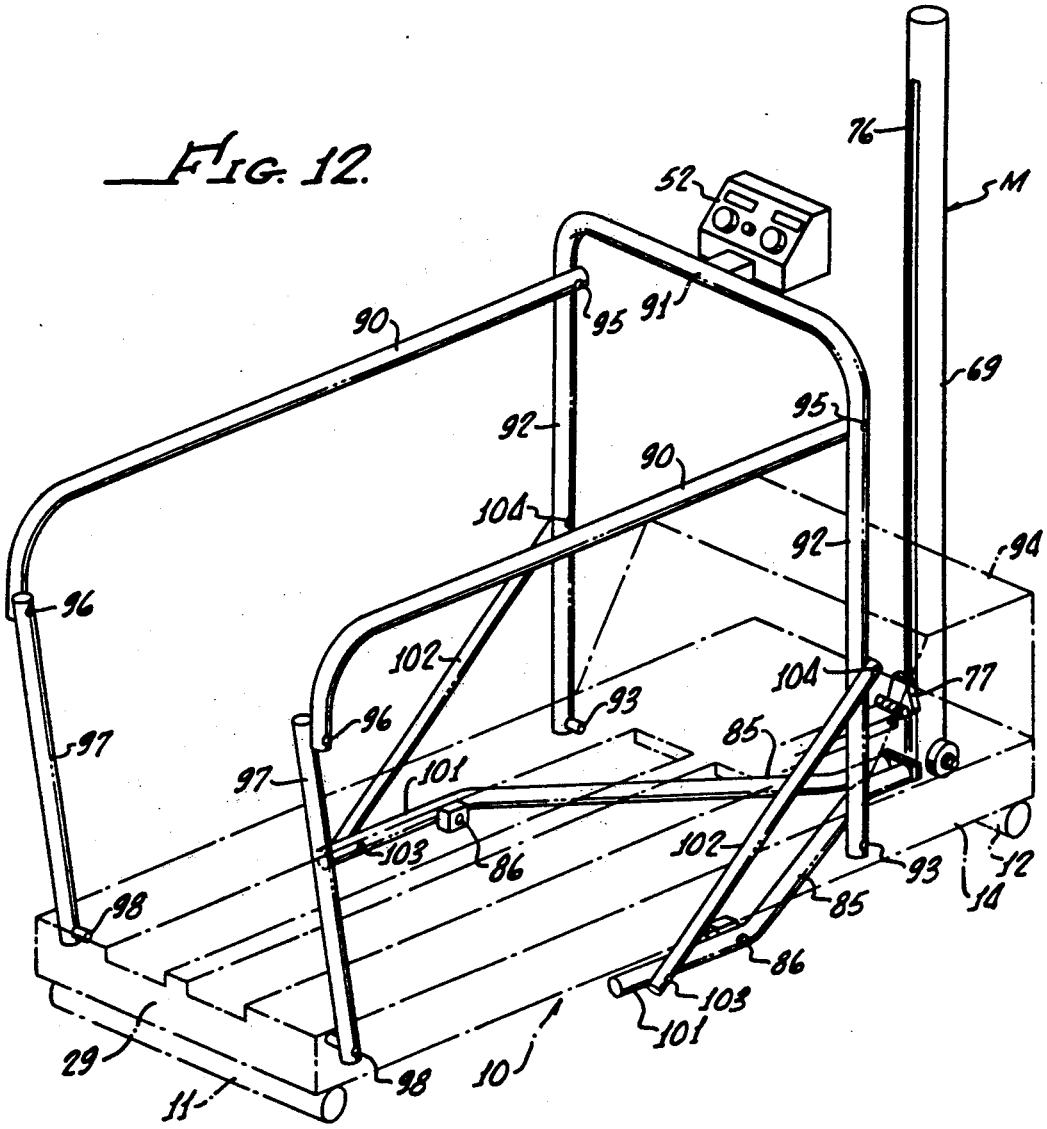
FIG. 12 is an isometric view of the entire compound linkage system.

Referring particularly to FIGS. 1 and 12, the apparatus comprises an elongate hollow platform 10 having transverse support members secured to the undersides of the back and front ends thereof, as shown at 11 and 12, respectively. Platform 10 has an upper wall 13 and side walls 14. Upper wall 13 has spaced-apart parallel track grooves 16 therein, which grooves have vertical sides 17 as shown in FIGS. 1 and 7. Each groove also has a bottom wall 18. The groove sides 17 and groove bottom 18 effectively prevent the exerciser from accidently stepping down into the inside of the platform 10.

Figure 6:
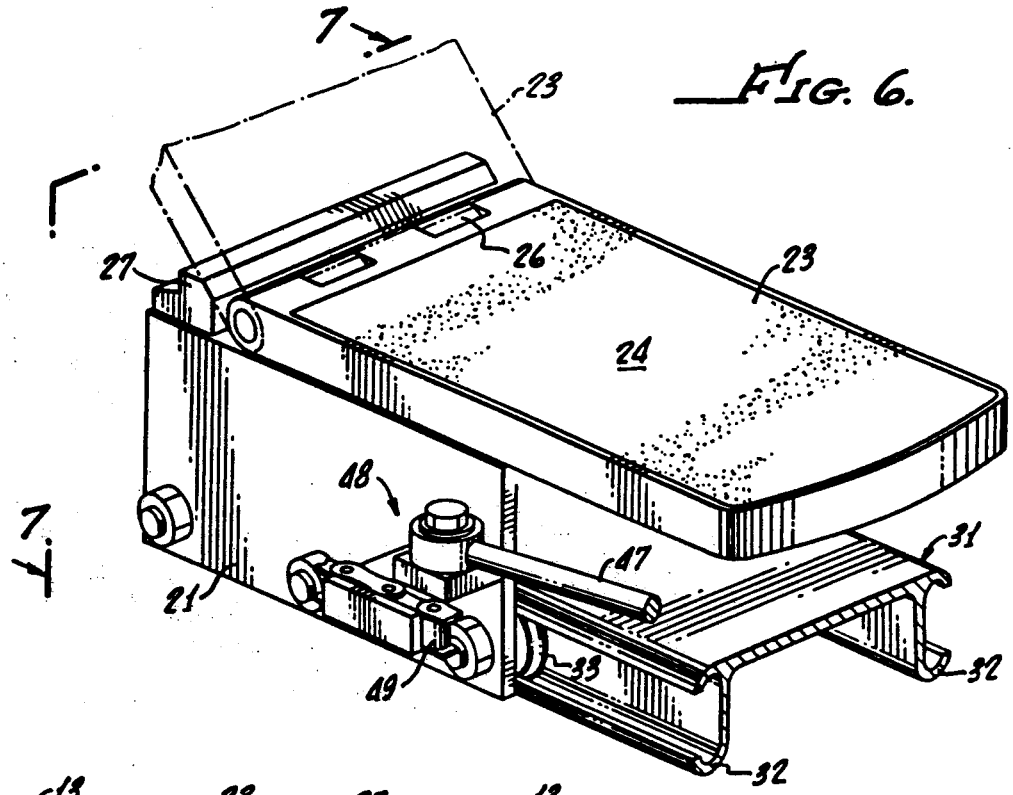
FIG. 6 is a fragmentary view showing one of the foot pads and its support means, the solid-lines showing the pad in position for exercising when the plane of oscillation is horizontal or relatively gently inclined, the phantom-line position corresponding to that of FIG. 1 and showing the pads set for oscillation in relatively steeply inclined planes.

Provided adjacent each side of each groove bottom wall 18 is a slot 20 (FIG. 7) through which extend side flanges 21 of an inverted short channel, the channel having a web 22 which is disposed parallel to and slightly above the groove bottom wall 18 (FIG. 7). Each web 22 pivotally supports a foot pad 23 as best shown in FIG. 6, each pad having slip-resistant rubber or other surfaces 24 on the top and bottom sides thereof.

Stated more specifically, a strong piano hinge 26 connects the rear end of each foot pad 23 with an associated web 22. Adjacent and to the rear of such piano hinge 26 is a stop bar 27, also mounted on the web, that limits the degree of pivoting of the foot pad 23. When foot pad 23 is in the solid-line position shown in FIG. 6, the foot pad is parallel to the upper platform wall 13. This is the position used when the platform is horizontal or at a gentle incline. When the platform is at a steep angle to the horizontal, for example, for climbing exercising, the foot pad 23 is pivoted about hinge 26 until it engages stop bar 27 as shown in phantom line in FIG. 6, and also in full line in FIG. 1. The other rubber surface (on the other side of the foot pad 23) is then used to support the feet of the exerciser during the climbing or other exercise.

Because the hinge 26 is at the back end of the channel web 22, foot pads 23 are at relatively low elevations when they are pivoted to their "climbing" position shown in FIG. 1. This makes it more easy for the exerciser to step onto the foot pads 23. It is to be understood that other types of mechanisms for inclining the foot pads, relative to the plane of the platform 10, may be provided.

Each of the two foot pads, and associated wheel and other structure, is identical to the other.

Figure 3:
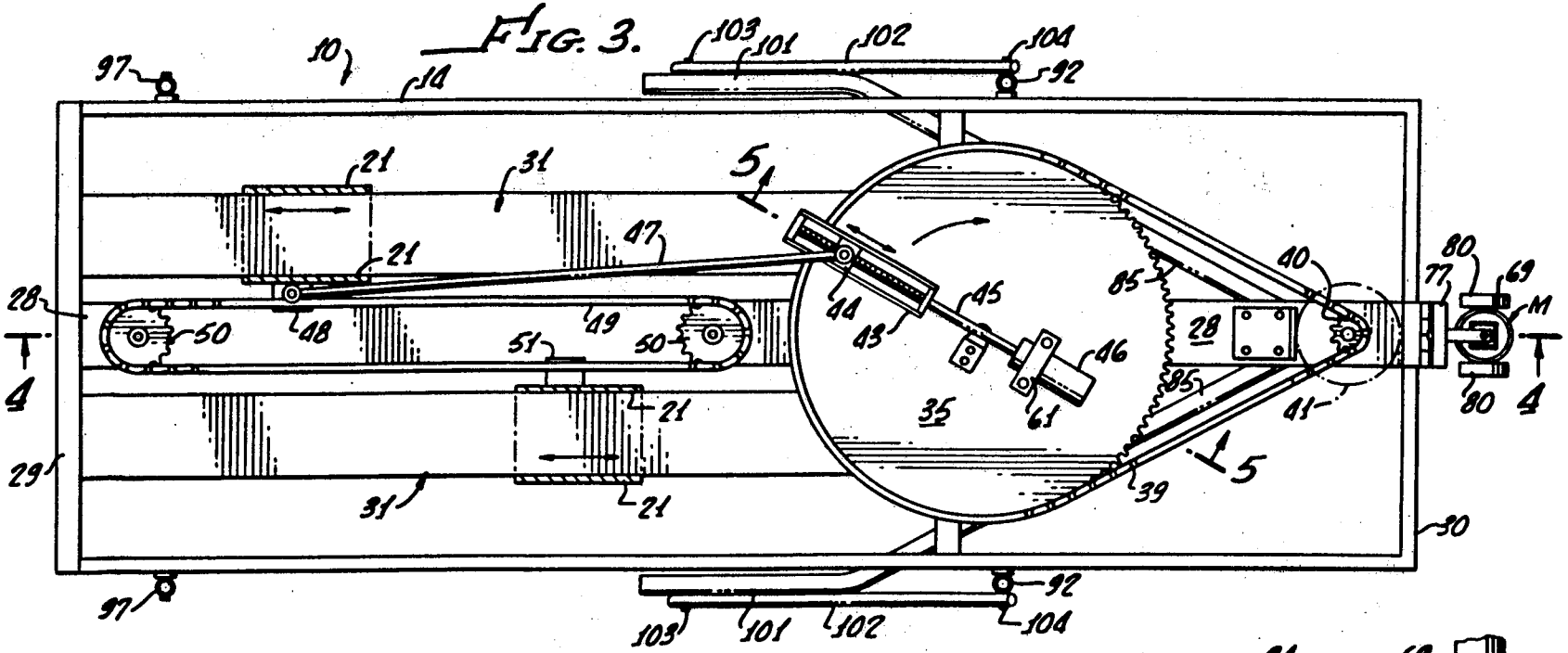
FIG. 3 is a horizontal sectional view showing the foot pads and the mechanism for driving them and for simultaneously adjusting stride length at any time.

Mounted longitudinally of platform 10 are a plurality of support and strengthening elements that are additional to the sidewalls 14 of the platform. The first such element is a channel 28 (FIGS. 3 and 4) that is midway between the platform sidewalls 14, and extends all the way from the rear wall 29 of the platform to a region in front of the front wall 30 of the platform (FIG. 3). Suitably supported on both sides of the channel 28, in spaced parallel relationship relative thereto, are tracks 31 shown fragmentarily and in section in FIGS. 6 and 7. Tracks 31 are also channel shaped; their depending flanges 32 being externally grooved so as to receive and trap wheels 33 that are provided at the lower edges of the above-mentioned channel side flanges 21.

In the preferred embodiment, there are four wheels 33 rotatably mounted on and spaced along each side flange 21, by means of bolts and nuts. Each wheel 33 rotates freely with low friction in the groove of each flange 32. Thus, in the absence of means described subsequently, each foot pad 23 can move freely in either direction along its track 31. To eliminate up and down play, there are preferably two alternated wheels 33 at a slightly higher elevation than two other alternated wheels. Each track 31 is sufficiently long to accommodate any desired length of stride that the exerciser might want to set the apparatus for.

Figure 4:
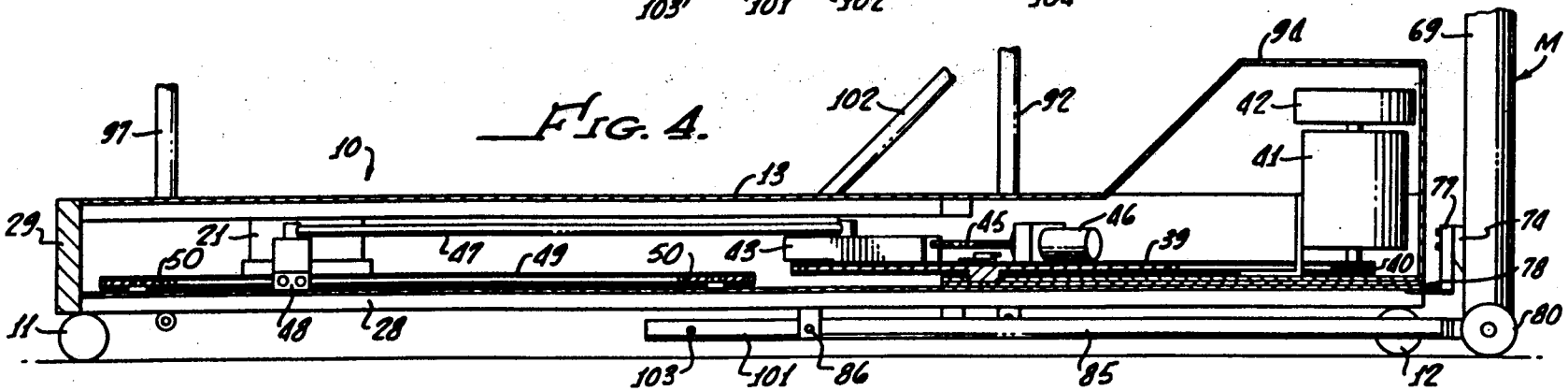
FIG. 4 is a vertical sectional view on line 4—4 of the FIG. 3.
Figure 5:
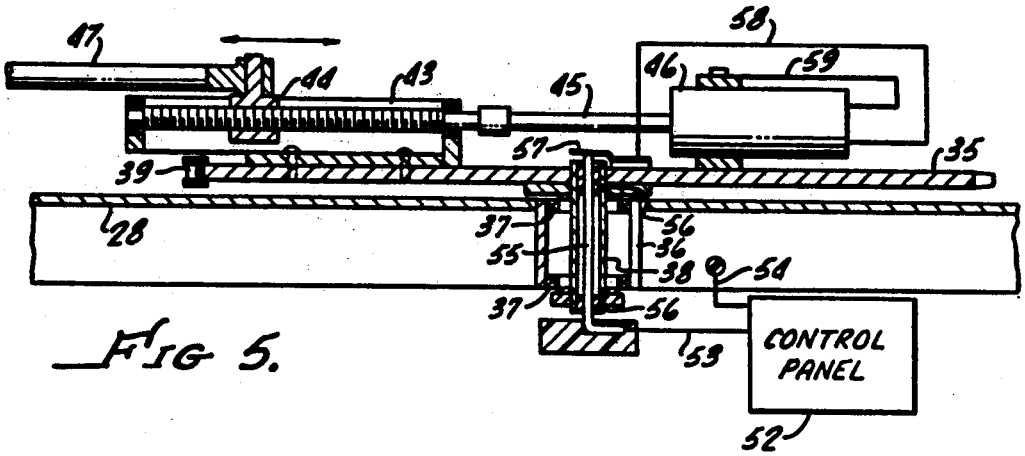
FIG. 5 is a fragmentary vertical sectional view on line 5—5 of FIG. 3, showing motor and circuit means for achieving stride adjustment.

Mechanism for Driving the Foot Pads 23 with Harmonic Motion, and for Simultaneously Adjusting the Stride Length of Both Foot Pads at any Time Referring to FIGS. 3 and 5, a large diameter circular gear plate 35 (which may be called a central gear) is rotatably mounted in spaced parallel relationship above a portion of channel 28. Stated more specifically, a metal tube 36 (FIG. 5) is mounted in channel 28 and has metal ball bearings 36 therein. These rotatably support in concentric relationship an elongate inner tube (shaft) 38 also formed of metal, the upper end of such inner tube being strongly connected to the center of the gear plate 35. A sprocket chain 39 is extended around gear plate 35 in meshed relationship therewith, being also mounted around the output gear (sprocket) 40 of a vertically-oriented D. C. motor 41. Motor 41 has a fly wheel 42 (FIG. 4) mounted concentrically on the shaft thereof.

(Because of the large size of gear plate 35 and the small size of output gear 40, there is a large mechanical advantage between motor 41 and the gear plate. A similar mechanical advantage may be obtained by using three gears: one such gear is on the motor, one is an intermediate gear, and one is a less-large central gear that directly drives the foot pads. There are then two chains, one from the motor to the intermediate gear and one from the intermediate gear to the central gear that directly drives the foot pads. The below-described stride adjustment mechanism on the central gear be on the underside thereof instead of on the upper side thereof.)

Mounted fixedly on gear plate 35, along a diameter thereof, is a frame 43 in which moves a nut 44. A threaded shaft 45 extends along the same diameter and is threadedly associated with nut 44, portions of the shaft being rotatably mounted in end regions of frame 43 so as to prevent the shaft from flexing. The shaft 46 extends away from frame 43 across the center of gear 35 and to a D. C. motor 46, the motor being suitably mounted on the gear by a clamp, and being oriented coaxially of shaft 45. Thus, operation of the motor 46 in either direction moves nut 44 either toward or away from the center of the gear. A portion of frame 43 projects beyond the periphery of the gear.

A connecting rod 47, in the nature of a pitman, it pivotally connected to nut 44 and also pivotally connected, by a means 48, to one side flange 21 (FIGS. 6 and 7) of the foot pad-supporting channel. The relationships are such that each end of the connecting rod 47 may pivot about a vertical axis (vertical when platform 10 is horizontal), suitable bearing means being provided for this purpose.

As best shown in FIG. 6, the means 48 for pivotally connecting rod 47 to the channel flange 21 also connects such rod 47, and flange 21, to a sprocket chain or belt 49. As shown in FIG. 3, chain 49 extends between sprockets 50 that are rotatably mounted on channel 28 at widely-spaced points therealong. The sprockets 50 are spaced apart sufficiently far apart to accommodate any stride length that the exerciser may desire.

Referring again to FIG. 3, the channel flange 21 of the channel above the other track 31 is also connected to chain 49, by a means indicated at 51 in FIG. 3. The connector means 48 and the connector means 51 are so located on opposite parallel runs of chain 49 as to be midway between sprockets 50 when shaft 45 on gear 35 is perpendicular to the central channel 28. Then, as the gear 35 rotates, the foot pads 23 move in opposite directions from the indicated central or starting points, with harmonic motion caused by the gear 35 and associated connector rod 47. When each foot pad is midway between the two sprockets 50, it moves at maximum speed. On the other hand, when shaft 45 is parallel to the central channel 28, each foot pad 23 has been gradually and harmonically brought to a full stop, instantaneously, prior to reversing direction and accelerating harmonically to full speed.

It is important that the exerciser be capable of adjusting stride length at any time, not just when the machine is stationary. He or she wants to have the stride which creates the proper "feel" for the particular exercise, and wants to do it without climbing on and off the machine for stride-adjustment or other purposes. The above-described motor 46 and associated screw 45, nut 44 and rod 47 effect such stride adjustment at any time, because a control panel 52 (FIGS. 1 and 5) is mounted on below-described rail means immediately in front of the exerciser.

The control panel is electrically associated with, or incorporates, rectifier and control means to deliver a D. C. voltage, of either polarity, to leads 53 and 54 (FIG. 5). Lead 53 connects to a rigid conductor 55 which extends coaxially through the inner tube 38 and out the upper end thereof, being insulated from the tube 38 by insulating cylinders 56. A brush means 57 connects the upper end of conductor 55 to a lead 58 that connects to one terminal of the motor 46. The other terminal of such motor connects to a lead 59 that is grounded through a metal support clamp 61 for the motor, through gear 35, through inner tube 38, through bearings 37, and through outer tube 36 to channel 28—the latter being connected through ground lead 54 back to the control panel 52.

Accordingly, by operating motor 46 in either direction through manipulation of switch means incorporated in panel 52 and manually operated by the exerciser, stride length can be adjusted as much as desired at any time. Because of the master-slave relationship between the two foot pads, stride adjustment is simultaneous.

Figure 2:
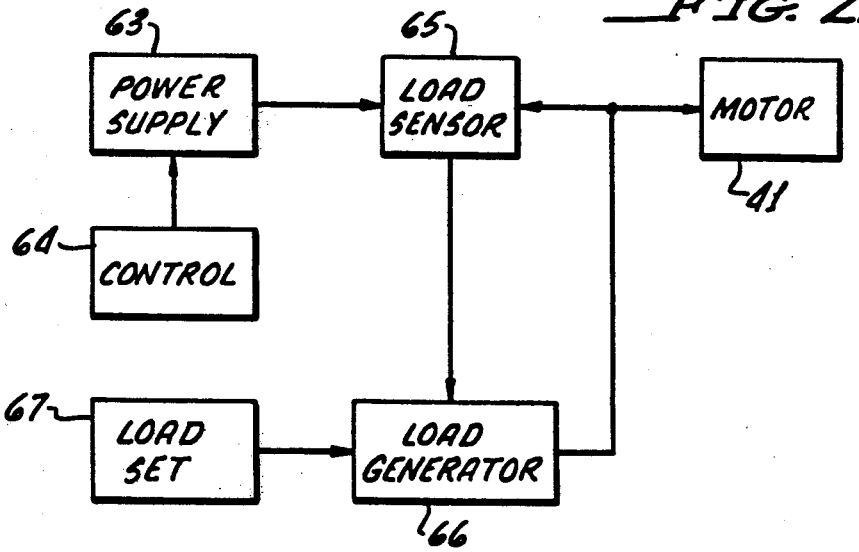
FIG. 2 is a block diagram of the circuit elements associated with the motor that drives or is driven by the foot pads.

Description of Means and Method for Changing Between Various Degrees of Passive Exercising and Various Degrees of Active Exercising While the Machine is Operating Referring next to FIG. 2, the above-described D. C. motor 41 for driving foot pads 23 receives power from, or delivers power to, the schematically represented circuit.

A power supply 63 receives A. C. power from the line (household power) and converts it to D. C., at an output voltage determined by the setting of a control 64. Such control 64 is incorporated into control panel 52 (FIG. 1), and is adjustable to change the D. C. output voltage between zero and any desired voltage. A load sensor (and isolator) 65 senses the voltage supplied to motor 41 from power supply 63; it also senses the voltage present at the terminals of motor 41 during periods when no power is being supplied thereto from power supply 63.

During time periods when control 64 is set to a level sufficiently high that power is delivered to motor 41 from supply 63, motor 41 acts as a motor to drive the foot pads 23. The speed of driving of the foot pads is at any one of an infinite number of speeds, as determined by the setting of control 64 and thus the output voltage of the power supply 63.

When control 64 is adjusted to such a setting that the power supplied to the motor 41 by the exerciser is greater than that supplied thereto by the power supply, motor 41 acts as a generator. Load sensor 65 then operates to isolate motor 41 from power supply 63. Furthermore, current is then passed from motor (generator) 41 through a load generator 66 controlled by a load set 67. Not only is control 64 incorporated into control panel 52 (FIG. 1), but load set 67 is also incorporated therein. The load generator 66 is a ballast resistor, or network thereof, which presents to the motor (generator) a resistance determined by the load set 67, which is preferably a rheostat.

As an example, let it be assumed that the control 64 is set to effect driving of motor 41 at a relatively high speed, so that foot pads 23 oscillate quite rapidly. Also, let it be assumed that the exerciser suddenly adjusts control 64 to its minimum setting, so that substantially no voltage is delivered to the motor from power supply 63. The motor and associated foot pads 23 do not then jerk or jolt to a stop. Instead, they come smoothly and progressively to a stop, in a quick, smooth and safe manner. This is the result of the electrical dynamic braking action effected by load generator 66, it being pointed out that sensor 65 suddenly causes current from motor 41 to circulate through load generator 66.

The same stopping action occurs when the exerciser pushes a stop button, also mounted on the control panel 52. Such button discontinues supply of power to motor 41, whereupon electrical dynamic braking action occurs to quickly and safely stop the foot pads in a progressive and smooth manner. It is pointed out that fly wheel 42 tends to keep the foot pads going, but that the ballast resistor or load generator 66 effectively stops the foot pads when desired.

As another example, let it be assumed that a person in poor health, or recuperating, is standing on the foot pads 23, or is being suspended in such manner that his or her feet are on the pads 23. The control 64 is then so set as to cause operation of motor 41 at a desired speed, so that walking, running, climbing, etc., can be simulated even if the person using the machine is incapable of self movement. Means, not shown, may be provided to secure the feet to the foot pads.

On the other hand, when a healthy individual uses the machine, the first motion may be with the control 64 set so as to operate motor 41 at a progressively higher speed, for warm up purposes. Then, the person doing the exercising may gradually reduce the setting of control 64 so that the speed of motion of the foot pads 23 progressively reduces. Then, especially if the load generator 66 is set at a relatively low value, the exerciser "overcomes the machine", that is to say puts power into the motor instead of letting the motor put power into the foot pads 23. The result is, therefore, an active exercise that has been changed from passive by the action of the exerciser in deciding to overcome the machine.

As another example, let it be assumed that the control 64 is so set that zero power is supplied by power supply 63. The exerciser again exercises actively as distinguished from passively, at any rate desired, and with a resistance determined by the setting of load set 67.

Accordingly, various settings and combinations of control 64 and load set 67, and various combinations of the desire of the exerciser to either be exercised or to supply power to the machine, may be employed for numerous combinations and types of exercises.

Figure 8:
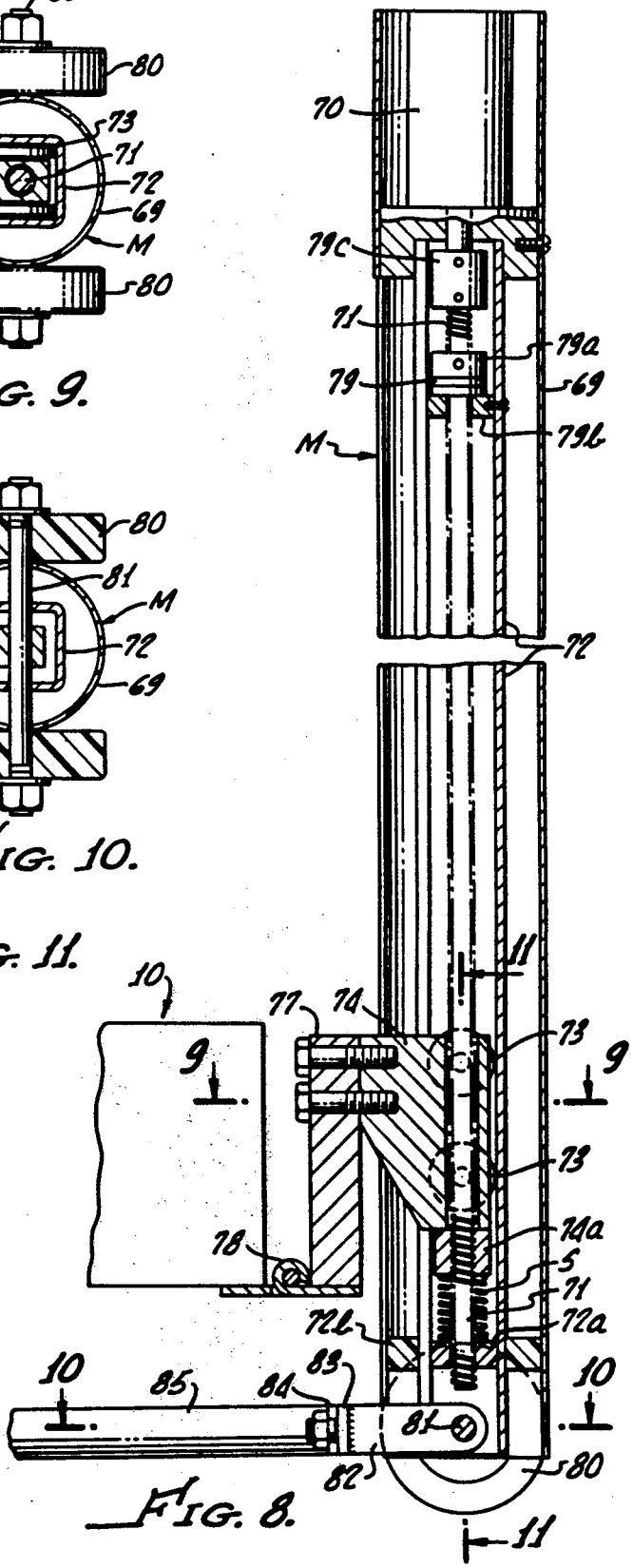
FIG. 8 is a view, primarily in vertical section, showing the tensioned lead screw and other means for changing the plane of oscillation of the foot pads.

Apparatus and Method for Tilting the Platform to Any One of an Infinite Number of Inclinations within the Desired Range The inclination-adjustment mechanism and linkage includes a self-standing mast M that need not be secured to a wall, etc. Mast M comprises an elongate vertical housing 69 having a vertically-oriented D. C. motor 70 at the upper end thereof (FIG. 8). Motor 70 is controlled by means (on-off and reversing) incorporated in the control panel 52 adjacent the exerciser. The wires that lead to motor 70 are disposed within the housing 69, and beneath the upper platform wall 13, so as to be largely concealed from view.

Motor 70 drives an elongate lead screw 71 that is rotatably mounted coaxially of the housing 69 as shown in FIG. 8. The screw 71 extends centrally through a channel-shaped support and track 72 adapted to receive and trap the four wheels 73 of a truck plate 74. Plate 74 has a substantial vertical dimension, and has two wheels 73 at the upper end thereof and two wheels 73 at the lower end thereof, as shown in FIG. 11, the wheels at each end being on a common axis. The wheels roll freely in the track 72, and cannot escape therefrom because the edges of the channel flanges are rolled over as shown at 75 (FIGS. 9 and 10) to do the trapping of the wheels. Because of the vertical spacing between the sets of wheels, the load is distributed along the screw, without side load.

Truck plate 74 is bored to rotatably receive the lead screw 71, the bore in the truck plate being unthreaded. The truck plate 74 extends toward platform 10, through a slot 76 that extends for the majority of the length of the housing 69 (FIGS. 1 and 12). As shown in FIG. 8, the outer portion of the truck plate 74 is bolted to a vertical bar 77 that, in turn, extends downwardly to a strong hinge 78. Hinge 78 is connected to the forward end of the platform 10 at the center thereof (FIGS. 8 and 12). Preferably, hinge 78 connects to the front end connects to the front end of channel 28 as shown in FIG. 4.

Truck plate 74 rests on a nut 74*a* that is grooved to receive the bottom of truck plate 74, as shown in FIG. 11. Nut 74*a* is threadedly associated with lead screw 71. It bears the downward force caused by the weight of the front end of platform 10.

It is a feature of the apparatus that lead screw 71 is loaded in tension. Therefore, and because of the spacing between the upper and lower sets of wheels 73, it remains straight and true, and effectively shifts nut 70. The lead screw is centered in channel and track 72 by an unthreaded bushing 72*a* in the lower end of channel and track 72. Housing 69 of the mast is held in proper concentric relationship by spacer ring 72*b* and other means.

As shown in FIGS. 8 and 11, a helical compression spring S is mounted coaxially around lead screw 71, being seated between nut 74*a* and bushing 72*a* when the nut is at low elevations. Spring S remains seated on the bushing 72*a* when plate 74 rises. After the plate 74 has risen sufficiently far to disengage the spring, the weight of the platform keeps the bottom edge of the truck plate in the groove in the upper side of the nut. Thus, the nut cannot rotate. When the lead screw is rotated in such direction as to lower the front end of the platform, front support member 12 (FIG. 12) engages the floor. Further rotation of lead screw 71 then causes the nut 74*a* to move downwardly away from the truck plate, at the same time compressing spring S. Thus, the entire weight of the front platform end is carried by cross member 12. When the lead screw is again reversed, spring S keeps the nut from rotating substantially as it moves upwardly until the bottom of the truck plate is in the nut groove. Preferably, such groove is wider than is such bottom edge.

Screw 71, and the large load it carries at nut 74*a*, is supported rotatably at its upper end by the following elements (FIG. 8): a thrust bearing 79 composed of parallel horizontal plates with bearing balls therebetween; a collar 79*a* fixedly secured to the lead screw and resting on the upper one of such thrust-bearing plates; and a second collar 79*b* fixedly secured to channel 72 and engaging the lower one of such thrust-bearing plates. A coupling 79*c* connects the upper end of the lead screw to the output shaft of motor 70.

Figure 9:
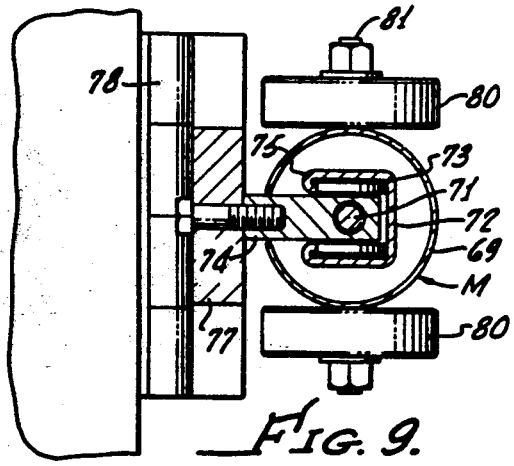
FIG. 9 is a fragmentary horizontal sectional view on line 9—9 of FIG. 8.
Figure 10:
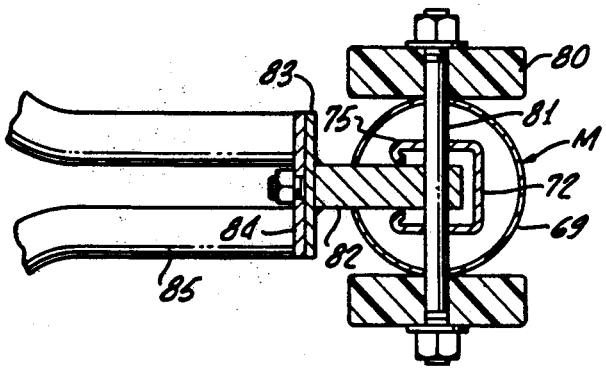
FIG. 10 is a fragmentary horizontal sectional view on line 10—10 of FIG. 8.
Figure 11:
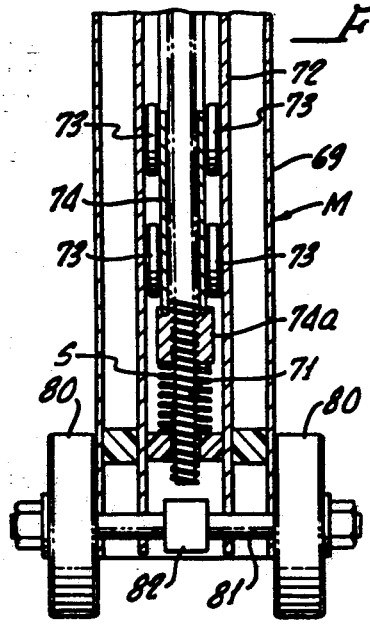
FIG. 11 is a fragmentary vertical sectional view on line 11—11 of FIG. 8.

Referring next to FIGS. 8–10, the mast M is supported on two support wheels 80 that rotate freely on an axle 81. The axle extends rotatably through housing 69 and through both flanges of the channel and track 72. Axle 81 also extends rotatably through a horizontal bar 82 that, in turn, is secured to a cross-member 83. Member 83 is bolted to a cross member 84 at the forward end of a yoke 85. Like plate 74, bar 82 extends through the slot 76 in housing 69.

Yoke 85 is preferably formed of two bars that are, as best shown in FIG. 12, close to each other at regions adjacent the vertical actuation element (Mast M). The bars spread apart in general Y-manner, being pivotally connected at 86 to the sides 14 of platform 10 at an intermediate region of the platform. Such region is so selected as to cause the Mast M to remain substantially vertical at all times, regardless of the degree of inclination of platform 10.

Thus, portions of the mast form one part of a three-part linkage. The yoke 85 forms another part thereof, and the region of platform 10 between pivot 86 and the mast forms the third part thereof.

When the motor 70 (FIG. 8) at the upper end of Mast M has been so adjusted that the front end of platform 10 is at its lowermost position, the platform rests on the front and rear supports 12 and 11 (FIG. 12), respectively. The platform is then horizontal and is adapted for walking, running, simulated skiing, etc.

Operation of motor 70 to lift nut 74*a* and thus truck plate 74, and accordingly the front end of platform 10, causes the support wheels 80 and the associated links to support the front end of the platform, while the rear support 11 remains the sole support for the back end of the platform. Wheels 80 roll along the supporting surface (floor) toward back support 11, gradually, as the motor 70 rotates lead screw 71 and lifts nut 74*a* to elevate truck plate 74 and the front platform end. This operation of the motor may be effected either while the exerciser is standing on the foot pads or prior or subsequent thereto.

The shape of the three-element linkage changes as the front platform end is raised or lowered. When the front platform end is close to the supporting surface, the triangle is very flat or collapsed. When the platform is at a steep elevation, the triangle is not flat, the triangle shown in FIG. 14 being a right triangle in that yoke 85 is perpendicular to platform 10 in that particular example.

The described triangle is an isosceles triangle, the length of yoke 85 from pivot 86 to the bottom of the mast being substantially equal to the distance from pivot 86 to truck plate 74. The isosceles relationship is what keeps Mast M vertical.

The Hand Rails and Associated Linkage Elements

There are two parallel side rails 90 and a front rail 91, all positioned so as to be readily grasped by the hands of the exerciser, and all giving the exerciser firm support—whether the platform 10 is horizontal or steeply inclined.

Figure 13:
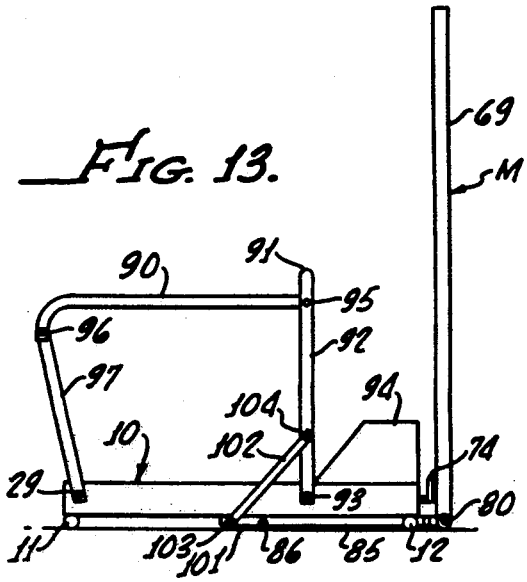
FIG. 13 illustrates schematically the linkages in the positions they are in when the platform is horizontal, the side rails also being horizontal and the actuation element being vertical.
Figure 14:
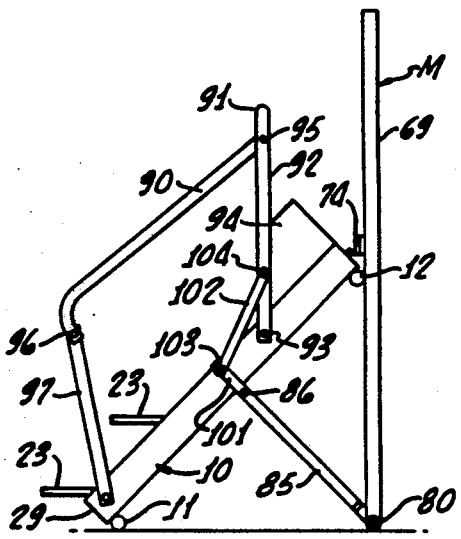
FIG. 14 is a view corresponding to FIG. 13 but showing the linkages in the position they are in when the platform is relatively steeply inclined, the side rails then also being inclined and substantially parallel to the platform, the front rail being shifted toward the still-vertical actuating element so as not to interfere with the exerciser.

As shown in FIGS. 13 and 14, side rails 90 are substantially parallel to platform 10 whether the platform is horizontal or inclined. Also as shown in those figures, front rail 91 moves closer to the mast as the platform becomes more and more inclined. The exerciser usually stands vertically, and the front rail 91 is at the proper position for grasping by the exerciser whether the platform 10 is horizontal or inclined. At no time does the front rail 91 come too close to the chest of the exerciser, even when the platform is steeply inclined as shown in FIG. 14. The described positions of the front rail also relate to the control panel 52 (FIG. 1) which is conveniently located for operation at all times regardless of platform inclination.

Front rail 91 is the "base" of an inverted U-shaped frame having vertical sides 92 that are pivotally connected to platform 14 at pivot points 93, these being preferably directly beneath front rail 91. The sides 92 are spaced sufficiently far apart that they do not engage a motor cover 94 that is provided at the front end of platform 10 and that covers the motor, flywheel, and associated elements (FIG. 6).

The rear ends of side rails 90 curve downwardly and pivotally connect, at 96, to the upper ends of back links 97. Links 97 extend downwardly and pivotally connect to the rear end of frame 10 at points 98. The curved regions at the rear ends of side rails 90 are preferably disposed slightly to the rear wall 29 of the back end of platform 10, for ready grasping of the exerciser as he or she mounts the foot pads 23.

Elements 90, 92 and 97, and the portion of platform 10 to the rear of pivot points 93, are generally in the nature of a parallelogram linkages. As previously noted, side rails 90 remain substantially parallel to platform 10 at all times. Elements 97 are only generally parallel to side elements 92 in the preferred embodiment, in order to provide for the rearward projection of the rear curved ends of sides 90. It is also to be noted that the sides 92 remain substantially parallel to the Mast M, as shown in FIGS. 13 and 14.

The above-described substantially parallelogram linkage is operated automatically in response to elevation of the front end of platform 10 by the vertical actuating mechanism. For this purpose, rearwardly-extending end extensions 101 are provided on yoke 85 at the yoke portions remote from the mast, such end extensions being horizontal when the platform is in its horizontal position. Actuating links 102 connect between such end extensions 101 and intermediate regions of side links or elements 92, being connected at pivot points 103 and 104. The pivot points and the link lengths are so selected as to maintain front rail 91 at the proper distance from the exerciser, at all times.

Referring again to FIGS. 13 and 14, when the vertical actuator lifts the front end of platform 10, the back portions of yoke 85, and including end extensions 101, are lifted while the front end of the yoke remains on or near the supporting surface. Accordingly, the yoke pivots clockwise about pivot connectors 86 as viewed in FIGS. 13 and 14. Such clockwise pivotal movement operates to shift the actuating links 102 and thereby pivot side links 92 clockwise relative to the platform 10, to thereby maintain the front rail 91 in the correct position.

It is to be understood that the present apparatus can be associated with known state-of-the-art computer controls, pulse rate monitors, blood pressure monitors, etc. As one example, as the optimum pulse rate of the exerciser peaks out, the apparatus may be caused to automatically enter a passive mode, with reduced resistance and/or lowered angle of incline from the horizontal surface, and/or change in stride length, or a combination of all.

The apparatus may incorporate an emergency switch mounted on the front rail 91 or on a side rail 90. Such switch is operated to the "on" state by being squeezed, and operates to the off state by being released. When released, the drive motor 41 stops and the foot pads come to a halt in the above-described smooth manner.

The foregoing detailed description is to be clearly understood as given by way of illustration and example only, the spirit and scope of this invention being limited solely by the appended claims.

What is claimed is:

1. Exercising apparatus, which comprises:

(a) track means, (b) first and second oscillating support elements mounted for movement on said track means and respectively adapted to support two limbs of the exerciser using the exercising apparatus, said track means and said support elements being so related that said first and second support elements can oscillate along substantially parallel paths relative to each other, said paths being spaced apart a distance generally corresponding to the distance between the supported limbs of the exerciser, (c) means to oscillate one of said support elements with harmonic motion, with no abrupt changes in speed, (d) means to connect said one support element to the other of said support elements to cause said other support element to oscillate with said one support element in master-slave relationship and 180 degrees out of phase relative to said one support element, and (e) means to change the amplitude of oscillation of said one support element to thereby simultaneously change the amplitude of oscillation of said other support element by the same amount.

2. The invention as claimed in claim 1, in which said means to change said amplitude of oscillation is operable while said oscillations of said support elements are occurring, at any oscillation speed within the operating speed range of said apparatus.

3. The invention as claimed in claim 1, in which said means to oscillate one of said support elements is a motor driven rotating element having a predetermined axis of rotation, in which a connector element is mounted on said support element and is adapted to move generally radially toward and away from said axis so as to be at a desired distance from said axis, in which a pitman is connected between said connector element and to said one support element to thereby cause oscillatory movement of said one support element with harmonic motion as said motor driven rotating element is driven by said motor, and in which said means to change the amplitude of oscillation comprises means to move said connector element generally toward and away from said axis to thus adjust the radius of said connector element relative to said axis.

4. The invention as claimed in claim 3, in which said means to connect said one support element to said other support element is a chain or belt mounted on spaced-apart sprockets, one run of said chain or belt being connected to said one support element, the other run of said chain being connected to said other support element.

5. The invention as claimed in claim 3, in which said means to change the amplitude of oscillation comprises a second motor mounted on said rotating element, and a screw mounted on said rotating element and driven by said second motor, said screw being threadedly associated with said connector element.

6. The invention as claimed in claim 5, in which said rotating element is mounted on a shaft, said shaft being journaled in bearing means including metal bearings, and in which power is supplied to said second motor through a circuit including said bearings.

7. The invention as claimed in claim 3, in which a flywheel is associated with said motor to tend to maintain the same in motion.

8. The invention as claimed in claim 3, in which control and circuit means are provided to effect controlled electrical dynamic braking of said motor.

9. The invention as claimed in claim 1, in which said means to oscillate one of said support elements includes a D. C. electric motor, and in which control and circuit means are provided to effect controlled dynamic braking of said motor.

10. The invention as claimed in claim 1, in which said means to connect said one support element to said other support element is independent of said means to oscillate said one support element.

11. Exercising apparatus, which comprises:

(a) movable means adapted to be engaged by one or more limbs of an exerciser, (b) a D. C. electric motor coupled with said movable means to drive the same or to be driven thereby, (c) a D. C. power supply for said motor, (d) control means to vary the voltage delivered by said power supply to said motor, said control means being adjacent said movable means for operation by said exerciser, (e) means to provide an electrically resistive load across the terminals of said motor, (f) means to cause said resistive load to be part of a dynamic braking circuit for said motor when said control means is set to cause said power supply to deliver a relatively low voltage, and (g) means to cause said motor to act as a generator when said exerciser is forcing said movable means with greater power than is provided by said power supply.

12. The invention as claimed in claim 11, in which means are provided to vary the magnitude of said electrically resistive load.

13. An exercising apparatus, which comprises:

(a) an elongate platform, (b) first and second parallel tracks mounted on said platform longitudinally thereof and generally parallel thereto, (c) first and second footpads movably mounted on said tracks for oscillatory movement thereon, said footpads being adapted to be stood upon by the exerciser, with one foot supported on each pad, (d) motor means to oscillate said pads on said tracks, (e) means to incline said platform and thus said tracks to any one of various inclined positions, and from said inclined positions, (f) hand rail means mounted above said platform in spaced relationship therefrom for grasping by the hands of the exerciser, said rail means including a front hand rial in advance of the exerciser, and (g) means provided to move said hand rail in a direction away from the exerciser when said platform is inclined.

14. The invention as claimed in claim 13, in which said means to incline said platform effects inclination thereof to any one of an infinite number of positions between generally horizontal and steeply inclined.

15. The invention as claimed in claim 13, in which said means to incline said platform comprises a motor-driven inclination mechanism associated with the front end of said platform.

16. The invention as claimed in claim 13, in which each of said footpads is adapted to be shifted from a position generally parallel to said platform to a position inclined from said platform, said last-named position being such that the exerciser may stand securely on said footpads when said platform is steeply inclined.

17. The invention as claimed in claim 15, in which said motor driven inclination mechanism comprises an elongate substantially vertical free-standing mast at the front end of said platform, said mast including a lead screw that drives a nut connected to said platform.

18. The invention as claimed in claim 13, in which said front hand rail movement means includes means to progressively and automatically effect said front hand rail movement as said means to incline said platform effects platform inclination to various inclined positions, and includes linkage means to effect said front hand rial movement in response to inclination of said platform.

19. Exercising apparatus for use at different inclinations, comprising:

(a) a platform, (b) movable means on said platform adapted to be stood upon by the exercise for movement of and exercising of the legs of the exerciser, and (c) elevation means to raise or lower one end of said platform progressively, to thus change between simulated walking and running, and simulated climbing, said elevation means comprising a motor, an elongate lead screw driven by said motor, a nut threadedly associated with said lead screw, and means to pivotally connect said nut to said one end of said platform for relative rotation therebetween about a horizontal axis to raise or lower said one end of said platform when said motor is operated to rotate said lead screw.

20. The invention as claimed in claim 19, in which said lead screw is mounted in generally vertical relationship in a free-standing mast, said mast being in advance of and adjacent the front end of said platform, the longitudinal position of said lead screw in said mast being fixed, said mast having an opening therealong to permit upward and downward movement of said means to pivotally connect said nut to said one end of said platform.

21. The invention as claimed in claim 20, in which thrust-bearing means are provided to support the upper end of said lead screw, said lead screw being loaded in tension when the weight of said front end of said platform bears down on said nut.

22. The invention as claimed in claim 20, in which said mast comprises an elongate support element mounted parallel to said lead screw, and in which wheel means are provided at the lower end of said support element, said wheel means resting on a support surface and rolling toward or away from said platform as said front platform end becomes more or less elevated.

23. The invention as claimed in claim 22, in which a yoke is pivotally connected to said support element at the lower end thereof, said yoke also being pivotally connected to said platform in spaced relation from the front end thereof, said yoke having such length and being so connected as to maintain said lead screw and said support element generally vertical regardless of the degree of inclination of said platform.

24. The invention as claimed in claim 19, in which an elongate and generally vertical support element is mounted parallel to said lead screw and has said motor mounted at the upper end thereof, the lower end of said support element being supported on the floor, said support element encompassing said lead screw, and in which said means associated with said nut include wheels disposed within said support element and riding on portions of said support element in wheel-track relationship.

25. The invention as claimed in claim 24, in which said wheels are vertically spaced along a part of said lead screw so as to prevent bending of said lead screw, said wheels being on a truck element that also is part of said means associated with said nut, said truck element being pivotally connected to said front end of said platform.

26. Exercising apparatus, comprising:

(a) an elongate platform, (b) movable means on said platform adapted to be employed to exercise limbs of an exerciser, (c) an elongate upstanding mast disposed at one end of said platform, the lower end of said mast being supported by the floor, (d) means to pivotally connect said one end of said platform to said mast, (e) means to move said pivotal-connector means to different points along said mast whereby to vary the inclination of said platform, and (f) a yoke pivotally connected to a lower portion of said mast and also pivotally connected to a portion of said platform spaced from said one end of said platform, said yoke, the region of said mast between said pivotal-connector means and said yoke, and the region of said platform between said pivotal-connector means and the pivot points where said yoke connects to said platform, comprising a three-element linkage, said linkage being so shaped as to keep said mast substantially vertical regardless of the inclined position of said platform.

27. The invention as claimed in claim 26, in which said three-element linkage is an isosceles triangle, the nonuniform side of said triangle being along said mast.

28. The invention as claimed in claim 26, in which hand rail means are provided pivotally on said platform, and in which means are provided to effect pivoting of said hand rail means in response to pivoting of said yoke, said pivoting of said yoke occurring as said pivotal-connector means moves along said mast.

29. The invention as claimed in claim 28, in which said last-named means are linkages, one side of said linkages being said platform, said linkages being generally parallelogram linkages.

30. The invention as claimed in claim 28, in which said hand rail means include a front rail disposed in advance of the exerciser, and in which said hand rail means and yoke are such that said front rail moves in a direction away from the exerciser as said platform is inclined to greater and greater angles from the floor, whereby the person on said platform does not become excessively close to said front rail when said platform is in steeply-inclines condition.

31. Apparatus for exercising on supports at various inclinations, with maximum safety, said apparatus comprising:

(a) an elongate platform having movable means thereon to support the feet of the exerciser when the exerciser is in standing position, (b) means to progressively raise and lower the front end of said platform so as to incline said platform to a large number of inclinations ranging from the steep to the gently inclined or horizontal, said means including motor means to effect said inclination automatically, (c) rail means mounted on said platform in spaced relationship above said platform and in front of the exerciser, said rail means being located for grasping by the hands of the exerciser while in said standing position, and (d) means to move said rail means forwardly as said platform inclines to greater and greater angles, and rearwardly as said platform inclines to smaller and smaller angles, whereby said rail means remains in position for convenient grasping by the exerciser regardless of the degree of incline of said platform.

32. The invention as claimed in claim 31, in which said means to incline said platform includes a mast disposed in advance of said platform and incorporating means to move vertically along said mast, said last-named means being pivotally connected to the front end of said platform, and in which said means to move said rail means includes linkage means associated with said mast, with said platform and with said rail means.

33. The invention as claimed in claim 32, in which said linkage means is a link the front end of which is pivotally connected to the lower end portion of said mast, an intermediate region of which is pivotally connected to said platform in spaced relationship from the front end of said platform, and a rear end of which is pivotally connected to an actuating link, and in which said rail means is pivotally supported from said platform and pivotally connected to said actuating link, all of said links being so sized and related as to effect said progressive movements in response to raising or lowering of the front end of said platform.

34. A self-contained automatic exercising apparatus for effecting multipurpose active or passive exercising of an exerciser, said apparatus comprising:

(a) elongate platform means, (b) first and second track means mounted on said platform means longitudinally thereof, (c) first and second footpads movably mounted on said respective track means for movement therealong in opposite directions, (d) motor means to effect harmonic motion of said footpads in 180-degree out-of-phase relationship to each other, (e) means to adjust the amplitude of said harmonic motion to thereby adjust the stride length of the exerciser using the apparatus, and (f) means to raise and lower the front end of said platform so that said platform and said track means are at any one of a large number of inclinations to the horizontal from substantially horizontal to relatively steep.

35. The invention as claimed in claim 34, in which means are provided to adjust said amplitude and stride length, and to adjust the inclination of said platform, said adjustment means being operable by the exerciser while standing on said footpads.

36. The invention as claimed in claim 34, in which said motor means for driving said footpads is a D. C. motor in which electrical circuit means are provided to effect dynamic braking of said motor, and in which means are provided to vary the voltage supplied to said motor and to vary the load present during said dynamic braking.

37. The invention as claimed in claim 34, in which linkage means are mounted above said platform and have upper rail portions adapted to be grasped by the exerciser both at his or her sides and in advance of his or her chest, and in which means responsive to inclination of said platform are provided to maintain said rail portions in substantially the same orientation to the exerciser regardless of the degree of inclination of said platform.

38. The invention as claimed in claim 34, in which said means to raise and lower said platform comprises a free-standing mast disposed adjacent the front end of said platform and having a lower portion provided with rollers and supported by the floor, said mast being connected to said platform by a yoke that extends pivotally to the lower end of said mast and extends pivotally to said platform at a point spaced a substantial distance from said front end of said platform, and in which said mast incorporates motor-driven means movable along said mast and pivotally connected to said front end of said platform.

39. Exercising apparatus, which comprises:

(a) reciprocating footpads adapted to be engaged by one or more limbs of an exerciser, (b) a D. C. electric motor coupled with said footpads to drive the same or to be driven thereby, (c) a D. C. power supply for said motor, (d) control means to vary the voltage delivered by said power supply to said motor, (e) a load sensor and isolator to sense the voltage supplied to said motor by said power supply, and to sense the voltage present at the terminals of said motor during periods when no power is being supplied to said motor from said power supply, and to isolate said motor from said power supply during periods when the power supplied to said motor by exerciser is greater than the power supplied to said motor by said power supply, (f) an electrical load circuit to presenting load to said motor, and (g) a load set to control said load to vary the magnitude of said load.

* * * * *